US008528528B2

(12) United States Patent
Fukui

(10) Patent No.: US 8,528,528 B2
(45) Date of Patent: Sep. 10, 2013

(54) VAPORIZED FUEL PROCESSING DEVICE FOR INTERNAL COMBUSTION ENGINE

(75) Inventor: Keita Fukui, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 377 days.

(21) Appl. No.: 13/087,474

(22) Filed: Apr. 15, 2011

(65) Prior Publication Data

US 2011/0253110 A1 Oct. 20, 2011

(30) Foreign Application Priority Data

Apr. 15, 2010 (JP) ..... 2010-094294

(51) Int. Cl.
*F02M 33/02* (2006.01)

(52) U.S. Cl.
USPC ..... 123/520; 123/518; 123/519; 123/516

(58) Field of Classification Search
USPC ... 123/514, 516, 518–520, 198 D; 73/114.39
See application file for complete search history.

(56) References Cited

U.S. PATENT DOCUMENTS

| | | | | |
|---|---|---|---|---|
| 5,575,265 | A * | 11/1996 | Kurihara et al. | 123/520 |
| 6,338,336 | B1 * | 1/2002 | Iida | 123/674 |
| 6,874,485 | B2 * | 4/2005 | Fujimoto | 123/520 |
| 2012/0186333 | A1 * | 7/2012 | Nishimura et al. | 73/40.5 R |

FOREIGN PATENT DOCUMENTS

| | | | |
|---|---|---|---|
| JP | 10054307 | A | 2/1998 |
| JP | 11280567 | A | 10/1999 |
| JP | 2000018104 | A | 1/2000 |
| JP | 2005256624 | A | 9/2005 |
| JP | 2006336618 | A | 12/2006 |

* cited by examiner

*Primary Examiner* — Stephen K Cronin
*Assistant Examiner* — Joseph Dallo
(74) *Attorney, Agent, or Firm* — Gifford, Krass, Sprinkle, Anderson & Citkowski, P.C.

(57) ABSTRACT

A vaporized fuel processing device includes a discharging passage having a canister and connected to a fuel tank, the discharging passage being provided with a stop valve and a relief valve that is opened when the pressure in a fuel tank is out of a first pressure range. A vaporized fuel processing device performs a purge flow detection process when the pressure in the fuel tank is within a second pressure range included in the first pressure range. On the other hand, the vaporized fuel processing device opens the stop valve when a purge is being performed, the frequency of performing the purge flow detection process is small, and the pressure in the fuel tank is out of the second pressure range.

4 Claims, 4 Drawing Sheets

VAPORIZED FUEL PROCESSING DEVICE FOR INTERNAL COMBUSTION ENGINE

CROSS-REFERENCE TO RELATED APPLICATIONS

This application claims priority to Japanese Patent Application No. 2010-094294 filed on Apr. 15, 2010, which is incorporated herein by reference in its entirety including the specification, drawings and abstract.

BACKGROUND OF THE INVENTION

1. Field of the Invention

The invention relates to a vaporized fuel processing device for an internal combustion engine, in which the fuel vapor produced in a fuel tank is introduced into an intake passage of the internal combustion engine and burned while the engine is in operation.

2. Description of the Related Art

In a vaporized fuel processing device for an internal combustion engine mounted on a vehicle or the like, the fuel vapor produced in a fuel tank is introduced into a canister and temporarily adsorbed by the adsorbing material in the canister. While the engine is in operation, a purge is performed, in which the air in the canister is sucked into the intake passage with the use of the negative pressure in the intake passage and air is introduced into the canister through an atmosphere introduction passage. By performing such a purge, the fuel adsorbed by the adsorbing material is desorbed and introduced into the intake passage along with the air, and the fuel desorbed from the adsorbing material is burned in the internal combustion engine.

In the above vaporized fuel processing device, by performing a purge to desorb the fuel adsorbed by the adsorbing material, the adsorbing capacity of the adsorbing material is recovered to suppress the occurrence of saturation of the adsorbing material. Thus, when the purge passage that allows the canister and the intake passage of the internal combustion engine to communicate with each other is clogged and closed, for example, and it therefore becomes impossible to normally perform the purge, the fuel cannot be desorbed from the adsorbing material and, as a result, the adsorbing material is easily saturated.

When the adsorbing material is saturated, the adsorbing material can no longer adsorb the fuel, so that the fuel vapor introduced into the canister passes through the canister and is discharged into the atmosphere through the atmosphere introduction passage.

Thus, in the vaporized fuel processing device for an internal combustion engine as described above, a purge flow detection process is performed, in which the pressure in the passage connected to the canister is detected to make sure that a flow of gas in the passage occurs as a purge is performed based on the pressure, while the purge is performed. In this way, by performing the purge flow detection process to make sure that a flow of gas in the passage connected to the canister occurs as the purge is performed and by making sure that the purge is being normally performed based on the result of the purge flow detection process, the reliability of the purge is ensured.

A vaporized fuel processing device is also available, in which a stop valve and a relief valve are provided between the canister and the fuel tank to hermetically close the fuel tank. In such a vaporized fuel processing device, in which the fuel tank is hermetically closed, when the stop valve or the relief valve is opened during a purge flow detection, the pressure in the passage connected to the canister varies as the valve is opened, so that it becomes impossible to accurately detect the flow of gas accompanying the purge based on the pressure in the passage.

Thus, in a vaporized fuel processing device for an internal combustion engine described in Japanese Patent Application Publication No. 2005-256624 (JP-A-2005-256624) that includes a relief valve that is opened when the pressure in a fuel tank becomes out of a predetermined first pressure range, it is inhibited to perform the purge flow detection process when the pressure in the fuel tank is out of a second pressure range included in the first pressure range and therefore there is a fear that the relief valve is opened. On the other hand, when the pressure in the fuel tank is within the second pressure range and therefore there is no fear that the relief valve is opened, the purge flow detection process is performed.

With such a configuration, it is possible to reduce the possibility that the relief valve is opened while the purge flow detection process is performed and the variation in pressure caused by the opening of the relief valve makes the result of the purge flow detection process incorrect.

However, when the fuel tank is hermetically closed, the decrease in the amount of fuel in the fuel tank due to the operation of the engine causes the pressure in the fuel tank to decrease because of the lowering of the liquid level. Thus, while the engine is in operation, the pressure in the fuel tank tends to be reduced to a level out of the second pressure range, at which level the relief valve can be opened, and therefore, when a configuration is employed, in which the purge flow detection process is performed when the pressure in the fuel tank is within the second pressure range, the number of times the purge flow detection process is performed becomes small.

Specifically, the number of times the purge flow detection process is performed to make sure that the purge is being normally performed becomes small and it therefore becomes difficult to secure the reliability of the purge, although the purge can be performed.

SUMMARY OF THE INVENTION

The invention provides a vaporized fuel processing device for an internal combustion engine, with which it is possible to prevent the frequency of performing a purge flow detection process from becoming small and at the same time, it is possible to reduce the possibility that a valve that hermetically closes the fuel tank is opened while the purge flow detection process is performed and the result of the purge flow detection process therefore becomes incorrect.

A first aspect of the invention is a vaporized fuel processing device for an internal combustion engine, including: a canister; a relief valve that, when a pressure in a fuel tank is out of a first pressure range, is opened to allow the fuel tank and the canister to communicate with each other; a stop valve that opens and closes a passage that bypasses the relief valve and allows the fuel tank and the canister to communicate with each other; and a control unit that performs a purge flow detection process when the pressure in the fuel tank is within a second pressure range included in the first pressure range, wherein the control unit opens the stop valve when a purge is being performed, a frequency of performing the purge flow detection process is small, and the pressure in the fuel tank is out of the second pressure range.

According to the first aspect of the invention, the stop valve is opened and the fuel tank and the canister are allowed to communicate with each other via the passage bypassing the relief valve when a purge is being performed, a frequency of performing the purge flow detection process is small, and the pressure in the fuel tank is out of the second pressure range, within which the purge flow detection process is performed.

Thus, the stop valve is opened and the fuel tank and the canister are allowed to communicate with each other to recover the pressure in the fuel tank to a level within the second pressure range when it is determined that the frequency of performing the purge flow detection process is small while the pressure in the fuel tank varies below the second pressure range as a result of lowering of the liquid level of the fuel stored in the fuel tank and, although a purge is being performed, the purge flow detection process is not performed. As a result, the purge flow detection process is performed, so that it is possible to suppress the occurrence of the situation where the purge flow detection process is not performed for a long period of time.

In addition, the purge flow detection process is performed when the pressure in the fuel tank is within the second pressure range included in the first pressure range, within which the relief valve is not opened. Thus, it is also possible to reduce the possibility that the relief valve is opened while the purge flow detection process is performed and the result of the purge flow detection process therefore becomes incorrect.

Thus, according to the first aspect of the invention, it is possible to prevent the frequency of performing a purge flow detection process from becoming small and at the same time, it is possible to reduce the possibility that a valve that hermetically closes the fuel tank is opened while the purge flow detection process is performed and the result of the purge flow detection process therefore becomes incorrect.

A second aspect of the invention is a vaporized fuel processing device for an internal combustion engine, including: a canister; a relief valve that, when a pressure in a fuel tank is out of a first pressure range, is opened to allow the fuel tank and the canister to communicate with each other; a stop valve that opens and closes a passage that bypasses the relief valve and allows the fuel tank and the canister to communicate with each other; a control unit that performs a purge flow detection process when the pressure in the fuel tank is within a second pressure range included in the first pressure range; and a memory that stores information indicating that the purge flow detection process is completed, wherein the control unit opens the stop valve when a purge is being performed, the information indicating that the purge flow detection process is completed is not stored in the memory, and the pressure in the fuel tank is out of the second pressure range.

According to the second aspect of the invention, the stop valve is opened and the fuel tank and the canister are allowed to communicate with each other via the passage bypassing the relief valve when a purge is being performed, the information indicating that the purge flow detection process is completed is not stored in the memory, and the pressure in the fuel tank is out of the second pressure range, within which the purge flow detection process is performed.

Thus, the stop valve is opened and the fuel tank and the canister are allowed to communicate with each other to recover the pressure in the fuel tank to a level within the second pressure range when it is determined that the information indicating that the purge flow detection process is completed is not stored while the pressure in the fuel tank varies below the second pressure range as a result of lowering of the liquid level of the fuel stored in the fuel tank and, although a purge is being performed, the purge flow detection process is not performed. As a result, the purge flow detection process is performed, so that it is possible to suppress the occurrence of the situation where the purge flow detection process is not performed for a long period of time.

In addition, the purge flow detection process is performed when the pressure in the fuel tank is within the second pressure range included in the first pressure range, within which the relief valve is not opened. Thus, it is also possible to reduce the possibility that the relief valve is opened while the purge flow detection process is performed and the result of the purge flow detection process therefore becomes incorrect.

Thus, according to the second aspect of the invention, it is possible to prevent the frequency of performing a purge flow detection process from becoming small and at the same time, it is possible to reduce the possibility that a valve that hermetically closes the fuel tank is opened while the purge flow detection process is performed and the result of the purge flow detection process therefore becomes incorrect.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
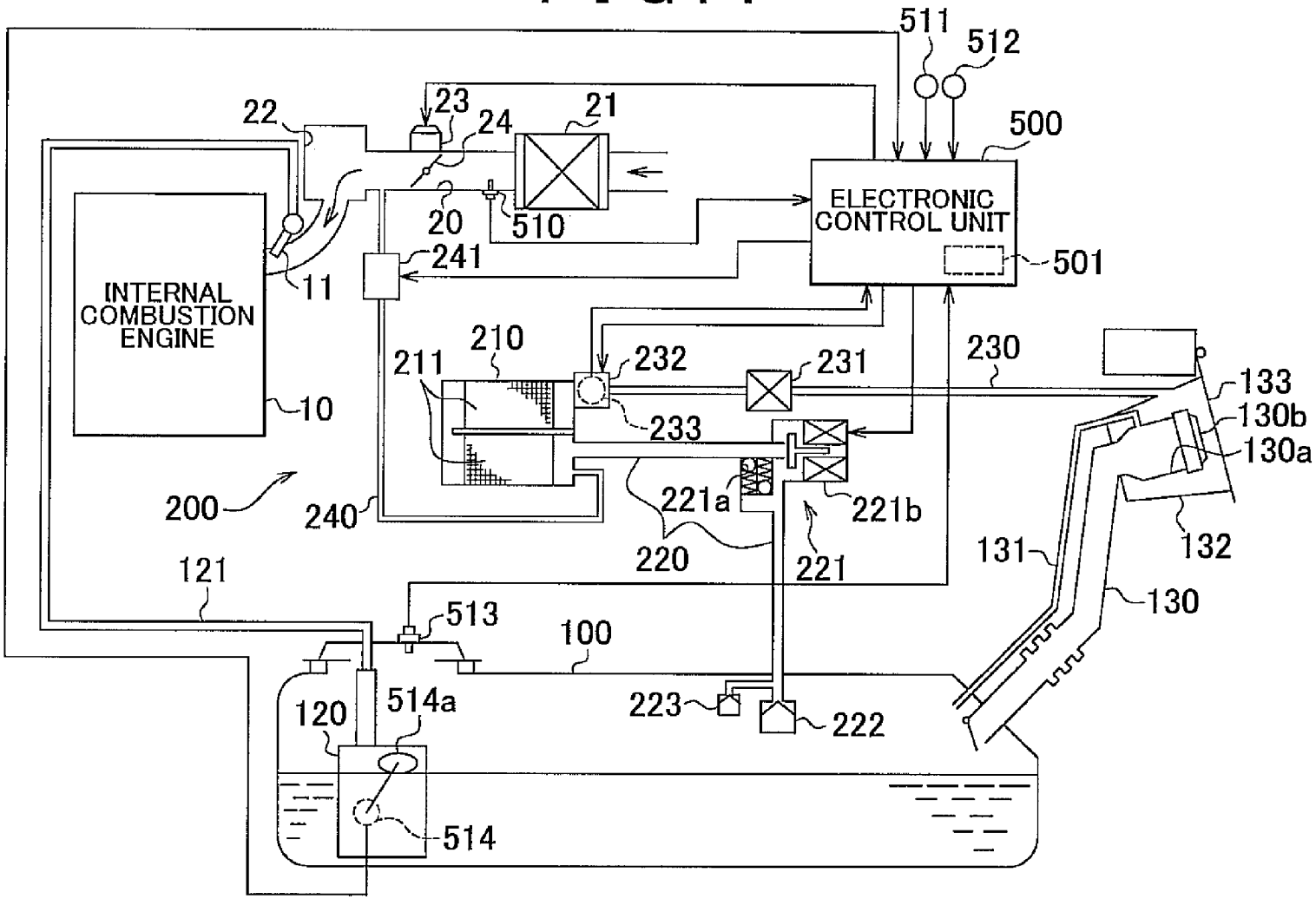
FIG. 1 is a schematic diagram showing a schematic configuration of a vaporized fuel processing device according to an embodiment of the invention.

A vaporized fuel processing device for an internal combustion engine according to the invention will be described below with reference to FIGS. 1 to 3, taking as an example an embodiment in the form of a vaporized fuel processing device for an internal combustion engine mounted on a vehicle. FIG. 1 shows a schematic configuration of the vaporized fuel processing device 200 according to the embodiment.

As shown in a lower part of FIG. 1, a fuel tank 100 is provided with a fuel pump module 120 that sucks up the fuel stored in the fuel tank 100. In an upper portion of the fuel tank 100, a tank pressure sensor 513 that detects the pressure Pt in the fuel tank 100 is provided.

The fuel pump module 120 is connected to an injector 11 of the internal combustion engine 10 via a fuel supply pipe 121. Thus, the fuel that is sucked up from the fuel tank 100 by the fuel pump module 120 is supplied to the injector 11 via the fuel supply pipe 121. Note that the fuel pump module 120 is provided with a fuel sender gauge 514 for detecting the level of the fuel stored in the fuel tank 100 based on the position of a float 514*a* that floats on the fuel stored in the fuel tank 100.

As shown in a right part of FIG. 1, a fuel inlet pipe 130 is fitted to the fuel tank 100. A fuel inlet port 130*a* that is located at a tip of the fuel inlet pipe 130 is housed in a fuel inlet box 132 provided in a body of the vehicle. Note that the fuel inlet pipe 130 is provided with a circulation pipe 131 that connects between an upper part of the fuel tank 100 and an upstream part of the fuel inlet pipe 130.

The fuel inlet box 132 is provided with a fuel lid 133. At the time of refueling, the fuel lid 133 is opened and a cap 130*b* attached to the fuel inlet port 130*a* is removed, whereby it is made possible to fill the fuel into the fuel tank 100 through the fuel inlet port 130*a*.

As shown in an upper part of FIG. 1, an injector 11 that injects the fuel supplied from the fuel tank 100 is provided in an intake passage 20 of the internal combustion engine 10. An air filter 21 that cleans fine particulates and the like contained in the intake air is provided at an entrance portion of the intake passage 20.

A throttle valve 24, the amount of opening of which is controlled by a motor 23, and that controls the intake air amount, GA, that is the amount of air taken into the internal combustion engine 10 is provided in a portion of the intake passage 20 upstream of a surge tank 22. In addition, an air flow meter 510 that detects the intake air amount GA is provided in a portion of the intake passage 20 upstream of the throttle valve 24.

As shown in a center part of FIG. 1, the vaporized fuel processing device 200 that processes the fuel vapor produced in the fuel tank 100 is connected to the intake passage 20 of the internal combustion engine 10. The vaporized fuel processing device 200 includes a canister 210 incorporating an adsorbing material 211 that adsorbs the fuel vapor. In this embodiment, the adsorbing material 211 is activated carbon that adsorbs fuel.

The canister 210 is connected to an upper portion of the fuel tank 100 via an discharging passage 220. As shown in FIG. 1, a stop valve unit 221 is provided in the discharging passage 220. The stop valve unit 221 includes a relief valve 221*a* that is opened when the pressure Pt in the fuel tank 100 becomes out of a predetermined, first pressure range and the difference in pressure between an upstream portion and a downstream portion of the discharging passage 220 with respect to the stop valve unit 221 becomes significantly large. The stop valve unit 221 includes the stop valve 221*b* that opens and closes the passage that bypasses the relief valve 221*a*. Note that the relief valve 221*a* is provided to suppress the occurrence of a situation where the pressure Pt in the fuel tank 100 becomes excessively high or excessively low and an excessive load is thus applied to the fuel tank 100. The first pressure range is set in consideration of the durability of the fuel tank 100. The stop valve 221*b* is an electromagnetically driven valve that is switched between an open state and a closed state according to the control command output from the electronic control unit 500.

Because the stop valve unit 221 is provided in the discharging passage 220, the discharging passage 220 is closed by the relief valve 221*a* and the stop valve 221*b* when the stop valve 221*b* is closed and the pressure Pt in the fuel tank 100 is within the first pressure range.

As shown in a lower part of FIG. 1, an entrance portion of the discharging passage 220 in the fuel tank 100 is provided with an on-board refueling vapor recovery (ORVR) valve 222 and a roll over valve 223.

The ORVR valve 222 is opened when the pressure Pt in the fuel tank 100 increases due to the rise of the fuel level caused by refueling. Thus, when the stop valve 221*b* is open, the increase in the pressure Pt in the fuel tank 100 due to the rise of the liquid level causes the fuel vapor in the fuel tank 100 to be introduced into the canister 210 through the discharging passage 220. Thus, the increase in the pressure Pt due to the rise of the liquid level is suppressed, so that the discharge of the fuel vapor into the atmosphere through the fuel inlet pipe 130 and the circulation pipe 131 at the time of refueling is suppressed.

The roll over valve 223 is closed when the vehicle is significantly tilted, so that the leakage of liquid fuel from the fuel tank 100 to the outside is prevented. The fuel vapor in the fuel tank 100 is introduced into the canister 210 through the discharging passage 220 when at least one of the relief valve 221*a* and the stop valve 221*b* is open and at least one of the ORVR valve 222 and the roll over valve 223 is open. The fuel vapor introduced into the canister 210 is adsorbed by the adsorbing material 211.

Connected to the canister 210 is an atmosphere introduction passage 230 that communicates with the fuel inlet box 132 provided in the body of the vehicle. An air filter 231 is provided in the atmosphere introduction passage 230. Note that a negative pressure pump module 232 that has a function of switching between a state where the negative pressure pump module 232 closes the atmosphere introduction passage 230 and a state where the negative pressure pump module 232 does not close the atmosphere introduction passage 230 and therefore allows the canister 210 and the fuel inlet box 132 to communicate with each other, is provided in a portion of the atmosphere introduction passage 230 downstream of the air filter 231. Note that a pump module pressure sensor 233 for detecting the pressure Pm of the air that flows through the negative pressure pump module 232 and is introduced into the canister 210, is provided in the negative pressure pump module 232.

In addition to the atmosphere introduction passage 230, a purge passage 240 that communicates with the intake passage 20 is connected to the canister 210. As shown in FIG. 1, a purge control valve 241 that is opened and closed according to the control commands output from the electronic control unit 500 is provided in the purge passage 240.

The pump module pressure sensor 233, the air flow meter 510, the tank pressure sensor 513, and the fuel sender gauge 514 are connected to the electronic control unit 500 that performs centralized control of the vehicle. In addition, various sensors, such as an accelerator position sensor 511 that detects the amount of driver's operation of the accelerator and a crank position sensor 512 that detects the engine speed NE, are connected to the electronic control unit 500.

The electronic control unit 500 includes a central processing unit (CPU) that performs the calculation related to control of the internal combustion engine 10 and the calculation related to control that is performed to drive respective parts of the vaporized fuel processing device 200. The electronic control unit 500 includes, as a memory for storing various pieces of information, such as results of calculation, a volatile memory 501 that can store and hold information while it is energized.

The electronic control unit 500 performs various calculations based on the signals output from the various sensors, and outputs control commands to respective parts to perform centralized control of the respective parts of the vehicle that include the vaporized fuel processing device 200.

For example, while the internal combustion engine is in operation, the electronic control unit 500 controls the motor 23 based on the engine speed NE that is detected by the crank position sensor 512 and the accelerator operation amount that is detected by the accelerator position sensor 511, whereby the throttle valve 24 is driven to control the intake air amount GA. In addition, the electronic control unit 500 controls the fuel injection amount by controlling the period of time, during which the injector 11 is opened, according to the intake air amount GA.

In addition, while the engine is in operation, the electronic control unit 500 controls the vaporized fuel processing device 200 to desorb the fuel that has been adsorbed by the adsorbing material 211 of the canister 210, thereby performing a purge to introduce the desorbed fuel into the intake passage 20 along with air.

Specifically, while the engine is in operation, the purge control valve 241 is opened to cause the air in the canister 210 to be sucked into the intake passage 20 through the purge passage 240 by the negative pressure in the intake passage 20. During this, the negative pressure pump module 232 is switched to the state where the negative pressure pump module 232 does not close the atmosphere introduction passage 230 and therefore allows the canister 210 and the fuel inlet box 132 to communicate with each other, whereby air is introduced into the canister 210 through the atmosphere introduction passage 230. In this way, the fuel that has been adsorbed by the adsorbing material 211 is desorbed and the desorbed fuel is introduced into the intake passage 20 through the purge passage 240 along with air.

When the purge is performed while the engine is in operation, the fuel adsorbed by the adsorbing material 211 is desorbed from the adsorbing material 211 and it is therefore possible to suppress the occurrence of saturation of the adsorbing material 211. In addition, because the desorbed fuel is introduced into the intake passage 20 along with air and burned in the internal combustion engine 10, the fuel vapor produced in the fuel tank 100 is prevented from being discharged into the atmosphere and is, instead, burned and removed.

Note that in the vaporized fuel processing device 200 of this embodiment, the stop valve 221*b* is closed to close the discharging passage 220 while the engine is stopped, except during refueling. Thus, the fuel tank 100 is hermetically closed in principle while the engine is stopped, so that the fuel vapor is not introduced into the canister 210 unless the pressure Pt in the fuel tank 100 becomes out of the first pressure range and the relief valve 221*a* is therefore opened.

Thus, the fuel vapor is prevented from being adsorbed by the adsorbing material 211 of the canister 210 during the stop of the internal combustion engine 10, during which no purge is performed, and therefore, it is possible to suppress the occurrence of saturation of the adsorbing material 211. In addition, when the fuel tank 100 is hermetically closed while the engine is stopped, it is possible to suppress the discharge of the fuel vapor that cannot be adsorbed by the adsorbing material 211, into the atmosphere through the canister 210 while the engine is stopped.

while the engine is stopped and the fuel tank 100 is hermetically closed, there is no space, into which the fuel vapor produced in the fuel tank 100 escapes, and therefore, the pressure Pt in the fuel tank 100 increases as the fuel vapor is produced.

When the cap 130*b* is removed and the fuel inlet port 130*a* is opened while the pressure Pt in the fuel tank 100 is higher than the atmospheric pressure Patm, the fuel vapor in the fuel tank 100 is discharged into the atmosphere through the fuel inlet pipe 130.

Thus, in the vaporized fuel processing device 200 of this embodiment, during refueling, the stop valve 221*b* is opened to introduce the fuel vapor in the fuel tank 100 into the canister 210 through the discharging passage 220, thereby reducing the pressure Pt in the fuel tank 100. After it is made sure that the pressure Pt in the fuel tank 100 has been sufficiently reduced based on the pressure Pt in the fuel tank 100 detected by the tank pressure sensor 513, the fuel lid 133 is unlocked.

With this configuration, in which the fuel lid 133 is unlocked after it is made sure that the pressure Pt in the fuel tank 100 has been sufficiently reduced, it is possible to suppress the discharge of the fuel vapor in the fuel tank 100 into the atmosphere through the fuel inlet pipe 130 when the fuel inlet port 130*a* is opened.

Note that as described above, in the vaporized fuel processing device 200, the fuel adsorbed by the adsorbing material 211 is desorbed by performing a purge and the desorbed fuel is introduced into the internal combustion engine 10 and burned therein, so that the adsorbing capacity of the adsorbing material 211 is recovered and the occurrence of saturation of the adsorbing material 211 is suppressed. Thus, when the purge passage 240 is clogged and closed, for example, the purge operation cannot be normally performed and the fuel cannot be desorbed from the adsorbing material 211, and as a result, the adsorbing material 211 is easily saturated.

In other words, when an abnormality occurs that inhibits normal purge operation as described above, the purge performed by opening the purge control valve 241 to recover the adsorbing capacity of the adsorbing material 211 cannot recover the adsorbing capacity of the adsorbing material 211, which results in the degradation of the reliability of the purge.

Thus, in the vaporized fuel processing device 200, during a purge, the pressure Pm in the negative pressure pump module 232 is detected by the pump module pressure sensor 233 to perform a purge flow detection process, in which it is determined based on the pressure Pm whether a flow of gas occurs in the purge passage 240 and the atmosphere introduction passage 230 when the purge is performed. In this way, by performing the purge flow detection process to make sure that a flow of gas occurs in the purge passage 240 and the atmosphere introduction passage 230 that are connected to the canister 210 as the purge is performed and by making sure that the purge is being normally performed based on the result of the purge flow detection process, the reliability of the purge is ensured.

Specifically, when the pressure Pm detected by the pump module pressure sensor 233 is equal to or lower than a reference pressure Ps that is lower than the atmospheric pressure while a purge is performed, based on this, it is determined that the purge is being normally performed, and on the other hand, when the pressure Pm is higher than the reference pressure Ps, based on this, it is determined that the purge is not being normally performed.

The reason why it is possible to determine whether the purge is being normally performed based on the pressure Pm is because a negative pressure due to the passage resistance in the air filter 231 occurs in a portion of the atmosphere introduction passage 230 downstream of the air filter 231 when a purge is being normally performed and a flow of gas occurs in the purge passage 240 and the atmosphere introduction passage 230. Specifically, when the purge is being normally performed, the air in the canister 210 is sucked into the intake passage 20 as the purge is performed, which produces a negative pressure in the portion of the atmosphere introduction passage 230 downstream of the air filter 231. Thus, in this case, the pressure Pm detected by the pump module pressure sensor 233 is equal to or lower than the reference pressure Ps that is lower than the atmospheric pressure Patm. On the other hand, when the purge is not being normally performed, the negative pressure in the portion of the atmosphere introduction passage 230 downstream of the air filter 231 is difficult to occur and the pressure Pm detected by the pump module pressure sensor 233 becomes higher than the reference pressure Ps.

Note that when the stop valve 221*b* and the relief valve 221*a* are opened while the purge flow detection process is performed, the pressure Pm in the portion of the atmosphere introduction passage 230 downstream of the air filter 231 varies and it becomes impossible to accurately detect the flow of gas accompanying the purge based on the pressure Pm.

Thus, in the vaporized fuel processing device 200 of this embodiment, similarly to the vaporized fuel processing device for an internal combustion engine described in JP-A-2005-256624, when the pressure Pt in the fuel tank 100 is out of a second pressure range included in the first pressure range and therefore there is a fear that the relief valve 221*a* is opened, it is inhibited to perform the purge flow detection process. On the other hand, when the pressure in the fuel tank 100 is within the second pressure range and therefore there is no fear that the relief valve 221*a* is opened, the purge flow detection process is performed.

Figure 2:
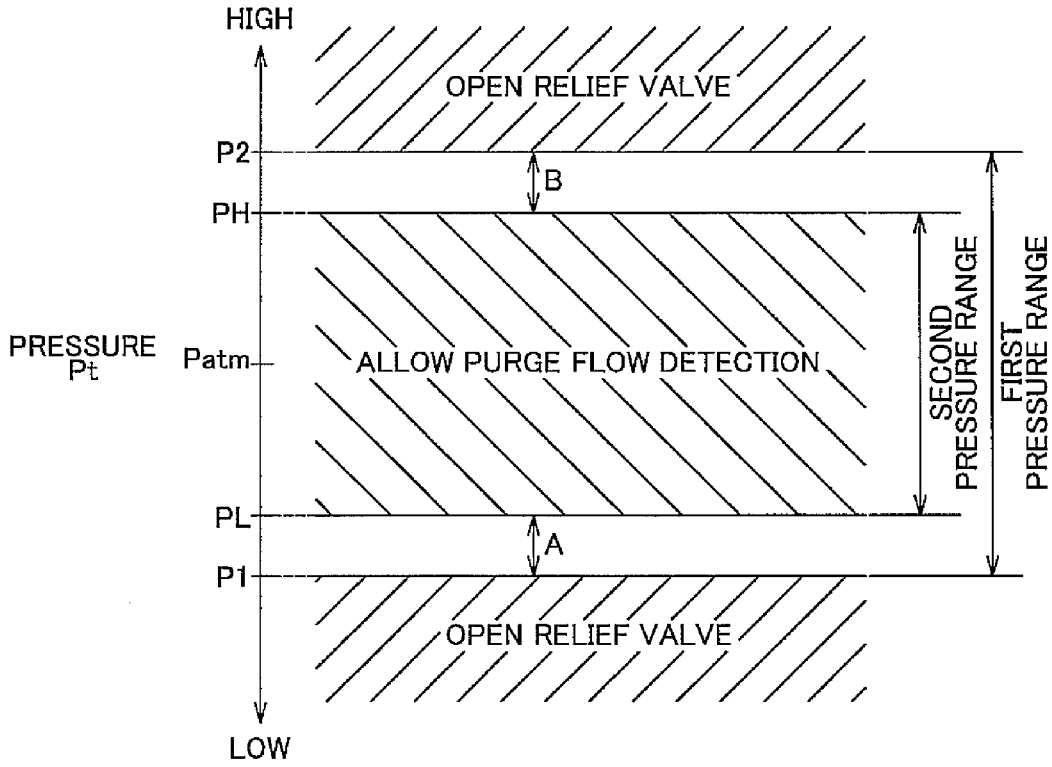
FIG. 2 is a explanatory diagram for explaining the relation between the pressure range, within which it is allowed to perform a purge flow detection process, and the pressures, at which a relief valve is opened.

Specifically, it is allowed to perform the purge flow detection process when the pressure Pt in the fuel tank 100 is within the second pressure range included in the first pressure range between a first pressure P1 and a second pressure P2, the first pressure P1 being the lower limit value of the pressures, at which the relief valve 221*a* is kept closed, the second pressure P2 being the upper limit value of the pressures, at which the relief valve 221*a* is kept closed, as shown in FIG. 2.

A lower limit pressure PL, which is the lower limit of the second pressure range, and an upper limit pressure PH, which is the upper limit of the second pressure range are set in consideration of the variations of the characteristics of the relief valve 221*a* that are caused by the manufacturing tolerances, aged deterioration, etc.

Specifically, the lower limit pressure PL is set to a value higher than the first pressure P1 by a margin A so that the relief valve 221*a* is not opened as long as the pressure Pt is equal to or higher than the lower limit pressure PL even when there are variations in the characteristics of the relief valve 221*a* and the pressure, at which the relief valve 221*a* is opened, is therefore higher than the first pressure P1.

On the other hand, the upper limit pressure PH is set to a value lower than the second pressure P2 by a margin B so that the relief valve 221*a* is not opened as long as the pressure Pt is equal to or lower than the upper limit pressure PH even when there are variations in the characteristics of the relief valve 221*a* and the pressure, at which the relief valve 221*a* is opened, is therefore lower than the second pressure P2.

By setting the upper limit pressure PH and the lower limit pressure PL to set the second pressure range in this way and performing the purge flow detection process when the pressure Pt in the fuel tank 100 is within the second pressure range, it is possible to prevent the relief valve 221*a* from being opened while the purge flow detection process is performed.

Thus, it is possible to reduce the possibility that the relief valve 221*a* is opened while the purge flow detection process is performed and the result of the purge flow detection process therefore becomes incorrect.

When the stop valve 221*b* is closed and the fuel tank 100 is hermetically closed, the decrease in the amount of fuel in the fuel tank 100 due to the operation of the engine causes the pressure Pt in the fuel tank 100 to decrease because of the lowering of the liquid level. Thus, while the engine is in operation, the pressure Pt in the fuel tank 100 tends to vary below the lower limit pressure PL, that is, within the region lower than the lower limit pressure PL in FIG. 2. Thus, when a configuration is employed, in which the purge flow detection process is performed when the pressure Pt in the fuel tank 100 is within the second pressure range, the number of times the purge flow detection process is performed becomes small.

Specifically, the number of times the purge flow detection process is performed to make sure that the purge is normally performed becomes small and it therefore becomes difficult to secure the reliability of the purge, although the purge can be performed.

Figure 3:
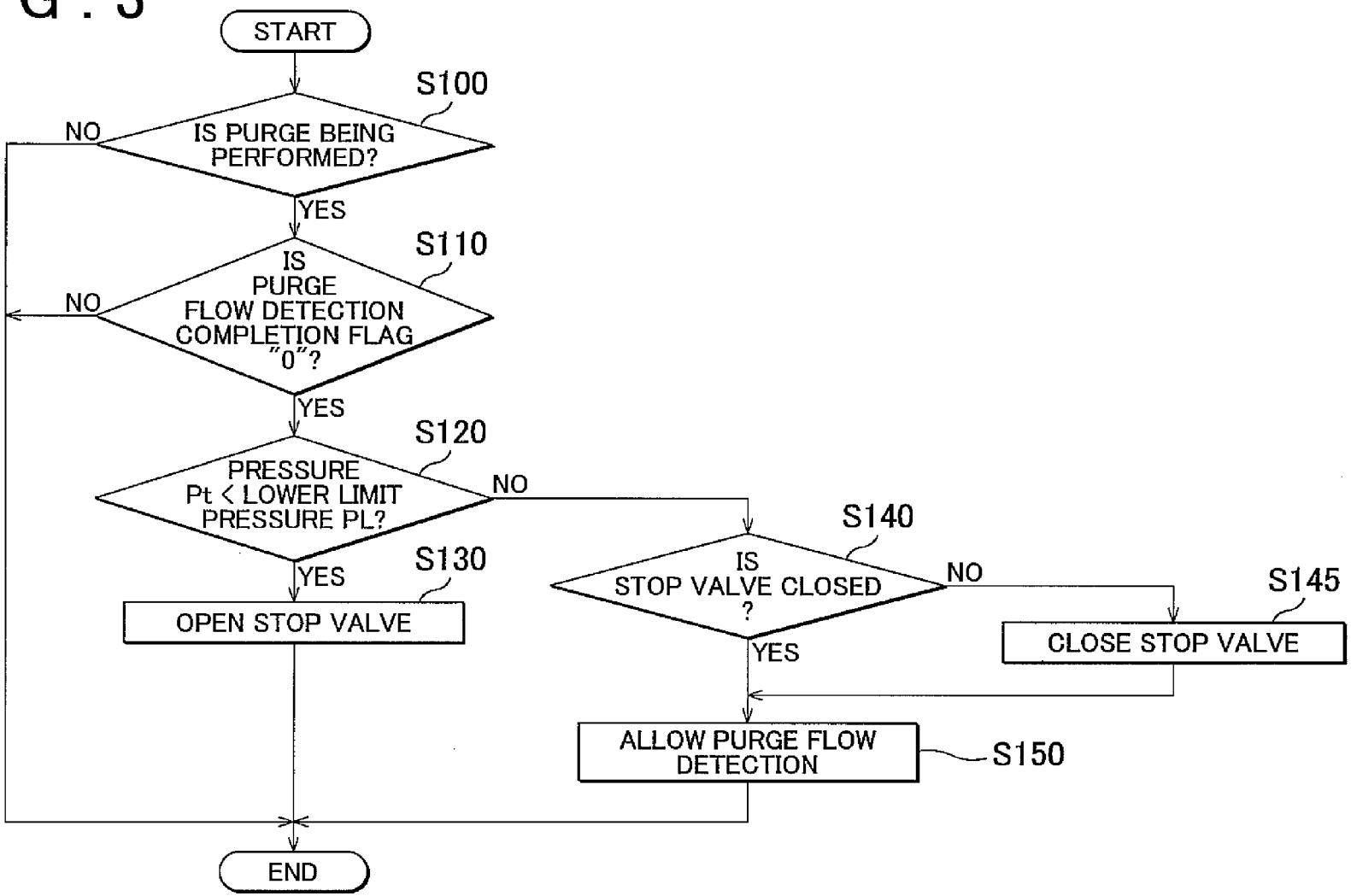
FIG. 3 is a flow chart showing a series of steps performed in a pressure recovery process according to the embodiment.

Thus, in the vehicle according to this embodiment, a pressure recovery process shown in FIG. 3 is performed to increase the number of times the purge flow detection process is performed, by opening the stop valve 221*b* to recover the pressure Pt in the fuel tank 100 to a level within the second pressure range.

The pressure recovery process according to this embodiment will be described below with reference to FIG. 3. FIG. 3 is a flow chart showing a series of steps of the pressure recovery process according to this embodiment.

The pressure recovery process shown in FIG. 3 is repeatedly performed in a predetermined control cycle by the electronic control unit 500 while the engine is in operation and the electronic control unit 500 is therefore energized. When the pressure recovery process is started, in step S100, the electronic control unit 500 first determines whether a purge is being performed. Whether a purge is being performed is determined based on whether the purge control valve 241 is open. Specifically, when the purge control valve 241 is open, it is determined that a purge is being performed and, when the purge control valve 241 is closed, it is determined that no purge is being performed.

When it is determined in step S100 that a purge is being performed (YES in step S100), the process proceeds to step S110. On the other hand, when it is determined in step S100 that no purge is being performed (NO in step S100), the electronic control unit 500 temporarily exits this process.

In step S110, the electronic control unit 500 determines whether a purge flow detection completion flag is "0". The purge flow detection completion flag is a flag that is stored in the volatile memory 501 of the electronic control unit 500 as the information indicating whether the purge flow detection process is completed. The purge flow detection completion flag is initially set to "0" that indicates that the purge flow detection process is not completed. When the purge flow detection process is completed, the purge flow detection completion flag is changed from "0" to "1" that indicates that the purge flow detection process is completed.

In this embodiment, the purge flow detection completion flag is stored in the volatile memory 501, the information in which is lost when the energization is stopped. Thus, every time the engine is stopped and the energization of the volatile memory 501 is stopped, the purge flow detection completion flag is initialized. Thus, in the vaporized fuel processing device 200 of this embodiment, when the engine is started, the purge flow detection completion flag is always "0", which is the initial value.

In step S110, when it is determined that the purge flow detection completion flag is "0" (YES in step S110), the process proceeds to step S120 and the electronic control unit 500 determines whether the pressure Pt in the fuel tank 100 is lower than the lower limit pressure PL.

On the other hand, when it is determined in step S110 that the purge flow detection completion flag is not "0" (NO in step S110), the electronic control unit 500 temporarily exits this process.

When it is determined in step S120 that the pressure Pt in the fuel tank 100 is lower than the lower limit pressure PL (YES in step S120), the process proceeds to step S130 and the electronic control unit 500 opens the stop valve 221*b*. When the stop valve 221*b* is opened in this way, the electronic control unit 500 temporarily exits this process.

On the other hand, when it is determined in step S120 that the pressure Pt in the fuel tank 100 is equal to or higher than the lower limit pressure PL (NO in step S120), the process proceeds to step S140 and the electronic control unit 500 determines whether the stop valve 221*b* is closed, thereby making sure that the stop valve 221*b* is closed.

When it is determined in step S140 that the stop valve 221*b* is closed (YES in step S140), the process proceeds to step S150, it is allowed to perform the purge flow detection process, and the pressure recovery process is temporarily exited.

On the other hand, when it is determined in step S140 that the stop valve 221*b* is open (NO in step S140), the stop valve 221*b* is closed in step S145, the process proceeds to step S150, it is allowed to perform the purge flow detection process, and the pressure recovery process is temporarily exited.

When the stop valve 221*b* is opened in step S130, air is introduced into the fuel tank 100 from the canister 210 side through the discharging passage 220 and the pressure Pt in the fuel tank 100 is therefore recovered to the level near the atmospheric pressure Patm.

Thus, while this pressure recovery process is repeatedly performed, the stop valve 221*b* is opened and then it is determined in step S120 that the pressure Pt in the fuel tank 100 is equal to or higher than the lower limit pressure PL, so that it is allowed to perform the purge flow detection process.

Specifically, when the above pressure recovery process is repeatedly performed, the stop valve 221*b* is opened when the results of all the determinations in steps S100 to S120 are affirmative, so that the pressure Pt in the fuel tank 100 is recovered to the level within the second pressure range. As a result, it is allowed to perform the purge flow detection process and the purge flow detection process is performed.

According to the above described embodiment, the following effects are brought about.

(1) As described above, when the pressure recovery process is performed, the stop valve 221*b* is opened when a purge is being performed, the information indicating that the purge flow detection process is completed is not stored in the volatile memory 501, and the pressure Pt in the fuel tank 100 is lower than the lower limit pressure PL, that is, out of the second pressure range.

Thus, the stop valve 221*b* is opened when it is determined that the purge flow detection completion flag is "0" while the pressure Pt in the fuel tank 100 varies below the second pressure range as a result of lowering of the liquid level of the stored fuel and, although a purge is being performed, the purge flow detection process is not performed. Thus, the fuel tank 100 and the canister 210 are allowed to communicate with each other and the pressure Pt in the fuel tank 100 is recovered to the level within the second pressure range. As a result, it is allowed to perform the purge flow detection process and the purge flow detection process is performed, so that it is possible to suppress the occurrence of the situation where the purge flow detection process is not performed for a long period of time.

In addition, the purge flow detection process is performed when the pressure Pt in the fuel tank 100 is within the second pressure range included in the first pressure range, within which the relief valve 221*a* is not opened. Thus, it is possible to reduce the possibility that the relief valve 221*a* is opened while the purge flow detection process is performed and the result of the purge flow detection process therefore becomes incorrect.

In summary, according to the above embodiment, it is possible to prevent the frequency of performing the purge flow detection process from becoming small and at the same time, it is possible to reduce the possibility that the relief valve 221*a* is opened while the purge flow detection process is performed and the result of the purge flow detection process therefore becomes incorrect.

(2) In the above embodiment, it is determined whether to open the stop valve 221*b*, by referring to the purge flow detection completion flag stored in the volatile memory 501, the information in which is lost every time the engine is stopped and the energization is therefore stopped. Thus, if no purge flow detection process has been performed since the engine was started, the stop valve 221*b* is opened and the pressure Pt in the fuel tank 100 is recovered to the level within the second pressure range. Thus, according to the vaporized fuel processing device 200 of this embodiment, the purge flow detection process is performed every time the internal combustion engine 10 is started.

Note that the above embodiment may be implemented in the following modes obtained by appropriately modifying the above embodiment.

In the above embodiment, in the pressure recovery process described with reference to FIG. 3, the stop valve 221*b* is opened to recover the pressure Pt, provided that it is determined that the purge flow detection completion flag is "0". The configuration, in which the stop valve 221*b* is opened provided that the purge flow detection completion flag is "0", is an example of the configurations designed to determine that no purge flow detection process is performed based on the fact that the purge flow detection completion flag is "0" and, based on this determination, determine whether the frequency of performing the purge flow detection process is small.

The configuration, in which it is determined whether the frequency of performing the purge flow detection process is small based on the purge flow detection completion flag stored in the volatile memory 501 may be modified as appropriate. For example, a configuration may be employed, in which a deleting device for deleting the information stored in the volatile memory 501 when a predetermined period of time has elapsed since a purge flow detection process is completed is additionally provided and the information stored in the volatile memory 501 is deleted every time the predetermined period of time has elapsed since a purge flow detection process is completed.

Figure 4:
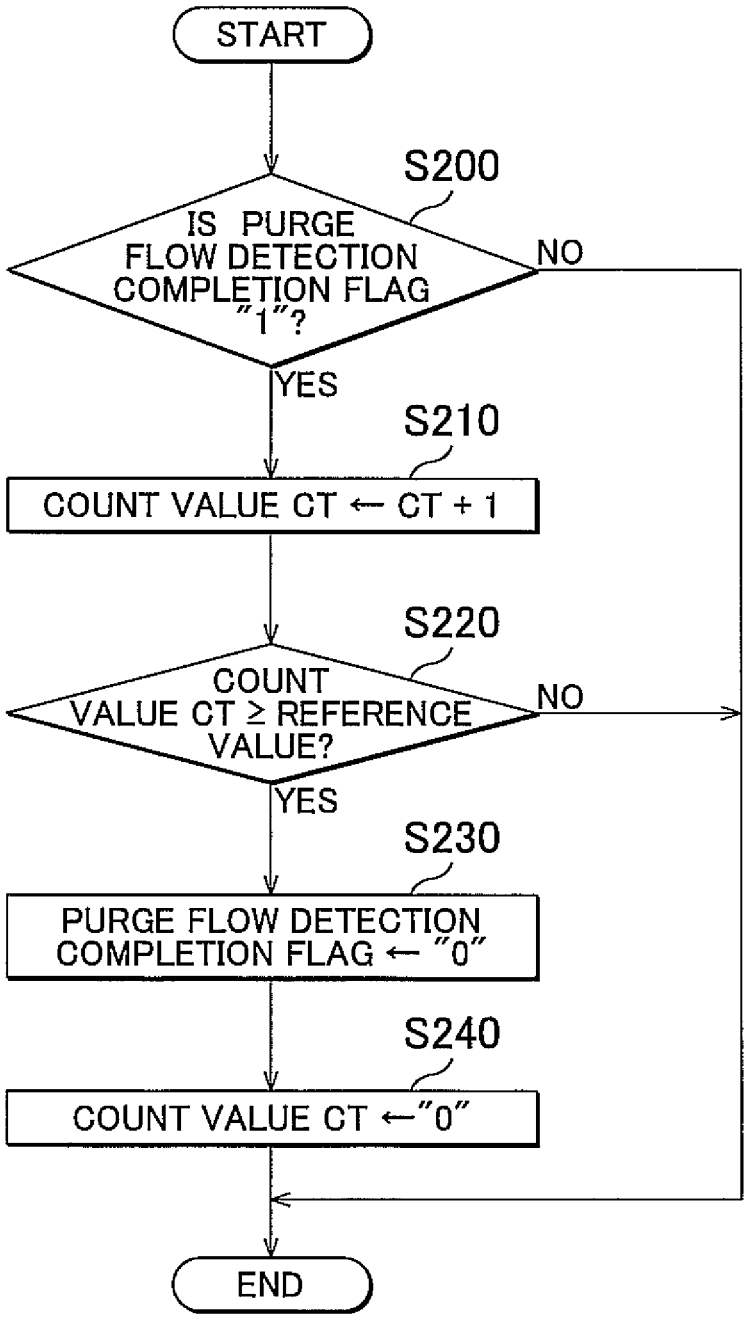
FIG. 4 is a flow chart showing a series of steps performed in a detection completion flag resetting process.

Specifically, in addition to repeatedly performing the pressure recovery process as described with reference to FIG. 3, a detection completion flag resetting process as shown in FIG. 4 may be repeatedly performed as the function of the deleting device while the engine is in operation.

FIG. 4 is a flow chart showing a series of steps in the detection completion flag resetting process, which functions as the deleting device. The detection completion flag resetting process is repeatedly performed in a predetermined cycle in the electronic control unit 500 while the engine is in operation.

When the detection completion flag resetting process is started, as shown in FIG. 4, in step S200, the electronic control unit 500 determines whether the purge flow detection completion flag is "1". When it is determined in step S200 that the purge flow detection completion flag is "0" (NO in step S200), the electronic control unit 500 temporarily exits this process.

On the other hand, when it is determined in step S200 that the purge flow detection completion flag is "1" (YES in step S200), the process proceeds to step S210 and the electronic control unit 500 increments a count value CT by "1". Specifically, "1" is added to the current count value CT and the count value CT, to which "1" has been added, is employed as the new count value CT, whereby the count value CT is incremented by "1".

Note that the count value CT is a value that is used to measure the time that has elapsed since the purge flow detection process is completed and the count value CT is initially set to "0". When the count value CT is incremented by "1" in step S210, the process proceeds to step S220 and the electronic control unit 500 determines whether the count value CT is equal to or greater than a reference value.

When it is determined in step S220 that the count value CT is equal to or greater than the reference value (YES in step S220), the process proceeds to step S230 and the electronic control unit 500 sets the purge flow detection completion flag to "0". Specifically, the electronic control unit 500 deletes the value of the purge flow detection completion flag, which is stored in the volatile memory 501 and is the information indicating that the purge flow detection process is completed, whereby the electronic control unit 500 resets the value of the purge flow detection completion flag to "0", which is the initial value. When the purge flow detection completion flag is reset to "0", the process proceeds to step S240 and the electronic control unit 500 resets the count value CT to "0" and the process is temporarily exited.

On the other hand, when it is determined in step S220 that the count value CT is still smaller than the reference value (NO in step S220), the electronic control unit 500 skips steps S230 and S240 and temporarily exits the process.

When such a detection completion flag resetting process is repeatedly performed, the information stored in the volatile memory 501 is deleted every time the predetermined period of time has elapsed since a purge flow detection process is completed. Thus, the stop valve 221*b* is opened by the pressure recovery process and the pressure Pt in the fuel tank 100 is recovered to the level within the second pressure range when a time period longer than the predetermined period of time has elapsed since a purge flow detection process is completed.

In summary, also when such a configuration is employed, it is possible to prevent the frequency of performing the purge flow detection process from becoming small and at the same time, it is possible to reduce the possibility that the relief valve 221*a* is opened while the purge flow detection process is performed and the result of the purge flow detection process therefore becomes incorrect.

By changing the reference value that is compared with the count value CT in step S220, the intervals, at which the purge flow detection completion flag is reset, are changed, which makes it possible to freely set the frequency of performing the purge flow detection process.

Alternatively, the deleting device may be configured to reset the purge flow detection completion flag every time the predetermined period of time has elapsed regardless of whether a purge flow detection process is completed, by omitting the step S200 in FIG. 4, for example. When such a configuration is employed, the value of the purge flow detection completion flag is deleted every time the predetermined period of time has elapsed. Thus, the stop valve 221*b* is periodically opened and the pressure Pt in the fuel tank 100 is periodically recovered to the level within the second pressure range, so that it is possible to suppress the occurrence of the situation where the purge flow detection process is not performed for a long period of time.

Note that when the deleting device is provided as described above, the memory for storing the purge flow detection completion flag may be a non-volatile memory that holds the stored memory even when energization is stopped.

In the above description of the embodiment, as a configuration for determining whether the frequency of performing a purge is small, a configuration is described, in which the purge flow detection completion flag, which is the information indicating whether the purge flow detection process is completed, is stored in the volatile memory 501 and, by referring to the purge flow detection completion flag, it is determined whether the frequency of performing a purge is small. However, as a configuration for determining whether the frequency of performing a purge is small, another configuration, in which a flag indicating whether a predetermined period of time has elapsed since a purge flow detection process is performed and, by referring to this flag, it is determined whether the frequency of performing a purge is small, may also be employed.

Specifically, a configuration may be employed, in which when the flag is set to a value indicating that the predetermined period of time has elapsed since the preceding purge flow detection process is performed, based on this, it is determined that the frequency of performing the purge flow detection is small and the stop valve 221*b* is opened.

Also when such a configuration is employed, by determining whether the frequency of performing the purge flow detection is small and, based on the result of this determination, opening the stop valve 221*b*, it is possible to recover the pressure Pt in the fuel tank 100 to the level within the second pressure range, which makes it possible to perform the purge flow detection process.

In the above description of the embodiment, as the sensor for detecting the purge flow, the pump module pressure sensor 233 provided in the negative pressure pump module 232 is taken as an example. However, the sensor for detecting the purge flow is not limited as long as the sensor can detect the flow of gas accompanying the purge. Thus, instead of the pump module pressure sensor 233, a pressure sensor may be provided at a position other than in the negative pressure pump module 232.

Although a configuration is described, in which the stop valve 221*b* and the relief valve 221*a* are formed in the stop valve unit 221, the relief valve 221*a* is not limited as long as the valve closes the discharging passage 220 that allows the fuel tank 100 and the canister 210 to communicate with each other and the valve is opened when the pressure Pt in the fuel tank 100 becomes out of the first pressure range. The stop valve 221*b* is not limited as long as the valve opens and closes the passage that bypasses the relief valve 221*a* and allows the fuel tank 100 and the canister 210 to communicate with each other. Specifically, instead of integrating the stop valve 221*b* and the relief valve 221*a* into the stop valve unit 221 as described in the above description of the embodiment, the stop valve 221*b* and the relief valve 221*a* may be provided separately. Alternatively, in addition to the discharging passage 220, a passage that bypasses the relief valve 221*a* may be provided and the stop valve 221*b* may be provided in the latter passage.

The configuration of the fuel tank 100 and the vaporized fuel processing device 200 described in the above description of the embodiment is an example of the embodiments of the invention. The configuration of the fuel tank 100 and the vaporized fuel processing device 200 may be modified as appropriate. As long as the control unit performs the control characteristic of the invention, the control unit of the invention is not limited to a single device, such as the above electronic control unit 500, but may be a collection of a plurality of controllers, for example.

As a specific configuration for determining that the frequency of performing the purge flow detection is small, a configuration may be employed, in which a memory that stores information indicating that the purge flow detection process is completed is provided, wherein, when the information indicating that the purge flow detection process is completed is not stored in the memory, it is determined that the frequency of performing the purge flow detection process is small.

When a configuration, in which the memory that stores the information indicating that the purge flow detection process is completed is a volatile memory, information in which is lost every time energization of the memory is stopped, is employed, the stop valve is opened and the pressure in the fuel tank is recovered to the level within the second pressure range when no purge flow detection process has been performed since the engine was started and energization was therefore started.

The vaporized fuel processing device may further include a deleting device that deletes the information stored in the memory every time a predetermined period of time has elapsed since the purge flow detection process is completed, wherein the information stored in the memory is deleted every time the predetermined period of time has elapsed since the purge flow detection process is completed.

According to the above configuration, the information stored in the memory is deleted every time the predetermined period of time has elapsed since the purge flow detection process is completed. Thus, the stop valve is opened and the pressure in the fuel tank is recovered to the level within the second pressure range when a time period longer than the predetermined period of time has elapsed since a purge flow detection process is completed.

A configuration may be employed, in which the information stored in the memory is deleted every time a predetermined period of time has elapsed. With such a configuration, the information stored in the memory is deleted every time the predetermined period of time has elapsed. Thus, it is possible to suppress the occurrence of the situation where the purge flow detection process is not performed for a long period of time.

The invention has been described with reference to example embodiments for illustrative purposes only. It should be understood that the description is not intended to be exhaustive or to limit form of the invention and that the invention may be adapted for use in other systems and applications. The scope of the invention embraces various modifications and equivalent arrangements that may be conceived by one skilled in the art.

What is claimed is:

1. A vaporized fuel processing device for an internal combustion engine, comprising:

a canister;

a relief valve that, when a pressure in a fuel tank is out of a first pressure range, is opened to allow the fuel tank and the canister to communicate with each other;

a stop valve that opens and closes a passage that bypasses the relief valve and allows the fuel tank and the canister to communicate with each other;

a control unit that performs a purge flow detection process when the pressure in the fuel tank is within a second pressure range included in the first pressure range; and a memory that stores information indicating that the purge flow detection process is completed, wherein the control unit opens the stop valve when a purge is being performed, the information indicating that the purge flow detection process is completed is not stored in the memory, and the pressure in the fuel tank is out of the second pressure range.

2. The vaporized fuel processing device for an internal combustion engine according to claim 1, wherein the memory is a volatile memory, information in which is lost every time energization of the memory is stopped.

3. The vaporized fuel processing device for an internal combustion engine according to claim 1, further comprising a deleting device that deletes the information stored in the memory every time a predetermined period of time has elapsed since the purge flow detection process is completed, wherein the information stored in the memory is deleted every time the predetermined period of time has elapsed since the purge flow detection process is completed.

4. The vaporized fuel processing device for an internal combustion engine according to claim 1, further comprising a deleting device that deletes the information stored in the memory every time a predetermined period of time has elapsed, wherein the information stored in the memory is deleted every time the predetermined period of time has elapsed.

* * * * *